US011780194B2

(12) United States Patent
Arimatsu

(10) Patent No.: US 11,780,194 B2
(45) Date of Patent: Oct. 10, 2023

(54) SUPPLY APPARATUS

(71) Applicant: ISHIDA CO., LTD., Kyoto (JP)

(72) Inventor: Tatsuya Arimatsu, Ritto (JP)

(73) Assignee: ISHIDA CO., LTD., Kyoto (JP)

( * ) Notice: Subject to any disclaimer, the term of this patent is extended or adjusted under 35 U.S.C. 154(b) by 72 days.

(21) Appl. No.: 17/579,590

(22) Filed: Jan. 20, 2022

(65) Prior Publication Data

US 2022/0234321 A1 Jul. 28, 2022

(30) Foreign Application Priority Data

Jan. 22, 2021 (JP) ..... 2021-008965

(51) Int. Cl.
*B31B 50/00* (2017.01)
*B31B 50/06* (2017.01)
*B31B 120/70* (2017.01)

(52) U.S. Cl.
CPC ..... *B31B 50/006* (2017.08); *B31B 50/062* (2017.08); *B31B 2120/70* (2017.08)

(58) Field of Classification Search
CPC ..... B31B 50/006; B31B 50/062; B31B 2120/70; B65H 7/02; B65H 7/04; B65H 1/30; B65H 1/025; B65H 2515/32; B65H 2515/10; B65H 2511/30; B65H 2511/515; B65H 2701/1766; B65H 2801/81
See application file for complete search history.

(56) References Cited

U.S. PATENT DOCUMENTS

| | | | | |
|---|---|---|---|---|
| 9,809,338 | B2 | 11/2017 | Gautheron | |
| 2007/0001363 | A1 | 1/2007 | Flagg et al. | |
| 2017/0102657 | A1* | 4/2017 | Yasuda | B65H 1/00 |
| 2017/0113888 | A1* | 4/2017 | Hyde | B65H 7/02 |

FOREIGN PATENT DOCUMENTS

JP 2019-147582 A 9/2019

OTHER PUBLICATIONS

The Search Report from the corresponding European Patent Application No. 22152300.4 dated Jul. 7, 2022.

* cited by examiner

*Primary Examiner* — Thomas M Wittenschlaeger
(74) *Attorney, Agent, or Firm* — SHINJYU GLOBAL IP

(57) ABSTRACT

A supply apparatus that supplies corrugated cardboard sheets to a supply position in a box-making section that opens folded corrugated cardboard sheets and makes boxes. The supply apparatus comprises a conveying unit, a drive unit, and a control unit. The conveying unit conveys a plurality of the corrugated cardboard sheets to the supply position with the corrugated cardboard sheets stacked. The drive unit drives the conveying unit. A controller, serving as the control unit, estimates the total quantity of the plurality of stacked corrugated cardboard sheets on a conveying surface of the conveying unit. The controller acquires a value pertaining to the drive force of the drive unit when the drive unit drives the conveying unit, and estimates the total quantity of the plurality of stacked corrugated cardboard sheets on the basis of the acquired value.

6 Claims, 9 Drawing Sheets

SUPPLY APPARATUS

CROSS-REFERENCE TO RELATED APPLICATIONS

This application claims priority to Japanese Patent Application No. 2021-008965, filed Jan. 22, 2021. The contents of that application are incorporated by reference herein in their entirety.

TECHNICAL FIELD

The present invention relates to a supply apparatus.

BACKGROUND ART

In the prior art, apparatuses that make, pack, and seal boxes are known, as is disclosed in Japanese Laid-open Patent Publication No. 2019-147582. It is conceivable that such an apparatus would be equipped with a supply apparatus that supplies a plurality of stacked corrugated cardboard sheets to a box-making section. In some cases, supply apparatuses include a photoelectric sensor for sensing the total quantity of the plurality of stacked corrugated cardboard sheets.

BRIEF SUMMARY

When an expensive sensor is employed as the photoelectric sensor included in the supply apparatus, the cost of manufacturing the supply apparatus may increase.

It is an object of the present invention to provide, at low cost, a supply apparatus that can estimate the total quantity of the plurality of stacked corrugated cardboard sheets.

A supply apparatus according to a first aspect of the present invention is a supply apparatus that supplies corrugated cardboard sheets to a supply position in a box-making apparatus that opens folded corrugated cardboard sheets and makes boxes. The supply apparatus comprises a conveying unit, a drive unit, and a control unit. The conveying unit conveys a plurality of the corrugated cardboard sheets to the supply position with the corrugated cardboard sheets stacked. The drive unit drives the conveying unit. The control unit estimates the total quantity of the plurality of stacked corrugated cardboard sheets on a conveying surface of the conveying unit. The control unit acquires a value pertaining to the drive force of the drive unit when the drive unit drives the conveying unit, and estimates the total quantity of the plurality of stacked corrugated cardboard sheets on the basis of the acquired value.

The inventors associated with the present application have discovered that the total quantity of the plurality of stacked corrugated cardboard sheets on the conveying surface of the conveying unit can be estimated on the basis of the value pertaining to the drive force of the drive unit driving the conveying unit.

In the supply apparatus according to the first aspect, the control unit estimates the total quantity of the plurality of stacked corrugated cardboard sheets on the basis of the value pertaining to the drive force of the drive unit. Therefore, in the supply apparatus according to the first aspect, the total quantity of the plurality of stacked corrugated cardboard sheets can be estimated by means of an inexpensive configuration.

A supply apparatus according to a second aspect of the present invention is a supply apparatus that supplies corrugated cardboard sheets to a supply position in a box-making apparatus that opens folded corrugated cardboard sheets and makes boxes. The supply apparatus comprises a weighing unit and a control unit. The weighing unit measures the weight of the plurality of stacked corrugated cardboard sheets. The control unit estimates the total quantity of the plurality of stacked corrugated cardboard sheets. The control unit estimates the total quantity of the plurality of stacked corrugated cardboard sheets on the basis of the value measured by the weighing unit.

In the supply apparatus according to the second aspect, the control unit estimates the total quantity of the plurality of stacked corrugated cardboard sheets on the basis of the value measured by the weighing unit. Therefore, in the supply apparatus according to the second aspect, the total quantity of the plurality of stacked corrugated cardboard sheets can be estimated by means of an inexpensive configuration.

A supply apparatus according to a third aspect is the supply apparatus according to the first or second aspect, wherein the control unit, on the basis of the estimated total quantity of the plurality of corrugated cardboard sheets, performs a process relating to automatically or manually replenishing the corrugated cardboard sheets.

In the supply apparatus according to the third aspect, a process relating to manually replenishing the corrugated cardboard sheets is performed when, for example, the total quantity of corrugated cardboard sheets is less than a predetermined value.

In the supply apparatus according to the third aspect, the operator of the supply apparatus will not have to monitor the supply apparatus any more than necessary. Therefore, with the supply apparatus according to the third aspect, operator labor is reduced.

A supply apparatus according to a fourth aspect, is the supply apparatus according to the third aspect, further comprising a notification unit. The notification unit issues a notification of information prompting replenishing of the corrugated cardboard sheets. The control unit performs, as said process, a process of causing the notification unit to issue a notification.

In the supply apparatus according to the fourth aspect, the operator of the supply apparatus will not have to monitor the supply apparatus any more than necessary. Therefore, with the supply apparatus according to the fourth aspect, operator labor is reduced.

A supply apparatus according to a fifth aspect is the supply apparatus according to the third aspect, wherein the control unit performs, as said process, a process of transmitting a signal to cause an action of automatically replenishing the corrugated cardboard sheets in the supply apparatus.

In the supply apparatus according to the fifth aspect, the control unit performs a process of transmitting a signal to cause an action of automatically replenishing the corrugated cardboard sheets in the supply apparatus as the process relating to automatically or manually replenishing the corrugated cardboard sheets. With this configuration, corrugated cardboard sheets are automatically replenished in the supply apparatus. Therefore, with the supply apparatus according to the fifth aspect, operator labor is reduced.

A supply apparatus according to a sixth aspect is the supply apparatus according to the first aspect, wherein the control unit estimates the total quantity of the plurality of stacked corrugated cardboard sheets on the basis of a relational expression between the value pertaining to the drive force of the drive unit and the total quantity of the plurality of stacked corrugated cardboard sheets.

A supply apparatus according to a seventh aspect is the supply apparatus according to any one of the first through sixth aspects, wherein the plurality of stacked corrugated cardboard sheets is placed on the conveying surface so as to be inclined relative to horizontal. The plurality of stacked corrugated cardboard sheets is conveyed while the lower ends of the plurality of corrugated cardboard sheets are in contact with the conveying surface.

With this configuration, dynamic friction is more accurately reflected in the value pertaining to the drive force of the drive unit. Therefore, with the supply apparatus according to the seventh aspect, the total quantity of the plurality of stacked corrugated cardboard sheets can be estimated with greater precision.

With an inexpensive configuration, the supply apparatus according to the present invention can estimate the total quantity of a plurality of stacked corrugated cardboard sheets.

DESCRIPTION OF EMBODIMENTS

Figure 1:
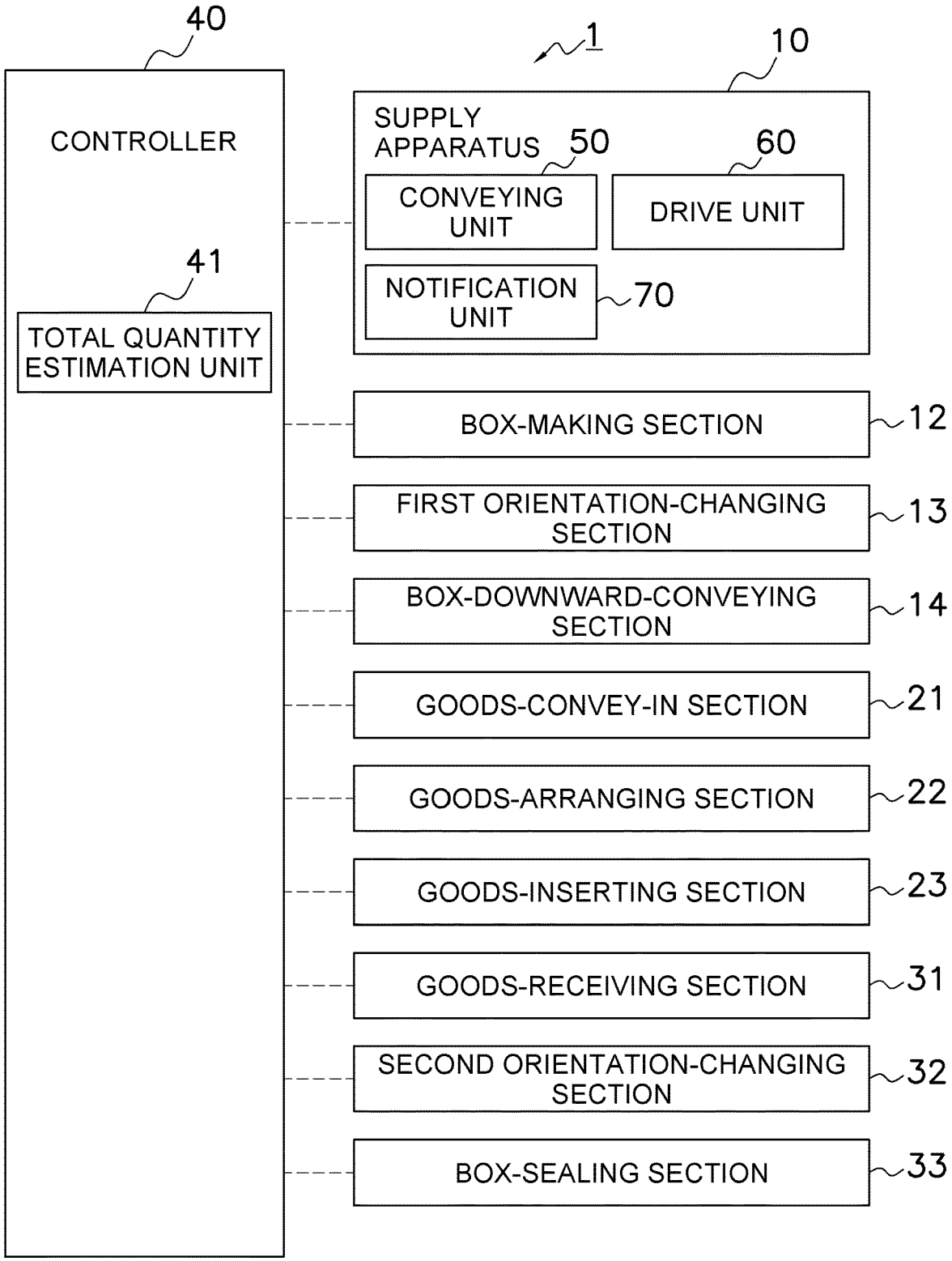
FIG. 1 is a block diagram of a box-packing system equipped with a supply apparatus.

A supply apparatus 10 according to one embodiment of the present disclosure is described below with reference to the drawings. Unnecessarily detailed descriptions are sometimes omitted. For example, descriptions of matters already known and duplicate descriptions of configurations that are substantially the same are sometimes omitted. This is to avoid unnecessary redundancy in the following descriptions and to facilitate comprehension for those skilled in the art.

The following embodiments are specific examples and are not intended to limit the technical range of the invention; the embodiments can be changed as appropriate within a range that does not deviate from the scope of the invention.

The following descriptions sometimes use the expressions "upper," "lower," "front" (front surface), "rear" (back surface), "left," "right," etc., for the sake of convenience in order to describe positional relationships and orientations. Unless otherwise specified, the directions indicated by these expressions are congruous with the directions of the arrows shown in the drawings.

Furthermore, the following descriptions sometimes use the expressions "parallel," "orthogonal," "perpendicular," "horizontal," "vertical," etc., but these expressions are not limited to cases in relationships such as parallel, orthogonal, perpendicular, horizontal, and vertical in the strict sense; this includes cases in relationships such as substantially parallel, orthogonal, perpendicular, horizontal, and vertical within a range in which the obtained results do not change significantly.

(1) Overall Configuration

FIG. 1 is a block diagram of a box-packing system 1 equipped with a supply apparatus 10 according to one embodiment of the present invention. The box-packing system 1 according to the present embodiment is a system for forming corrugated cardboard boxes B from corrugated cardboard sheets Z and packing a fixed number of goods G into the formed corrugated cardboard boxes B. This example is not provided by way of limitation, but in the box-packing system 1 according to the present embodiment, at most ten corrugated cardboard boxes B are packed every minute. In the present embodiment, the actions of the parts of the box-packing system 1 are controlled by a controller 40 (equivalent to the control unit described in the claims), as shown in FIG. 1.

Figure 2:
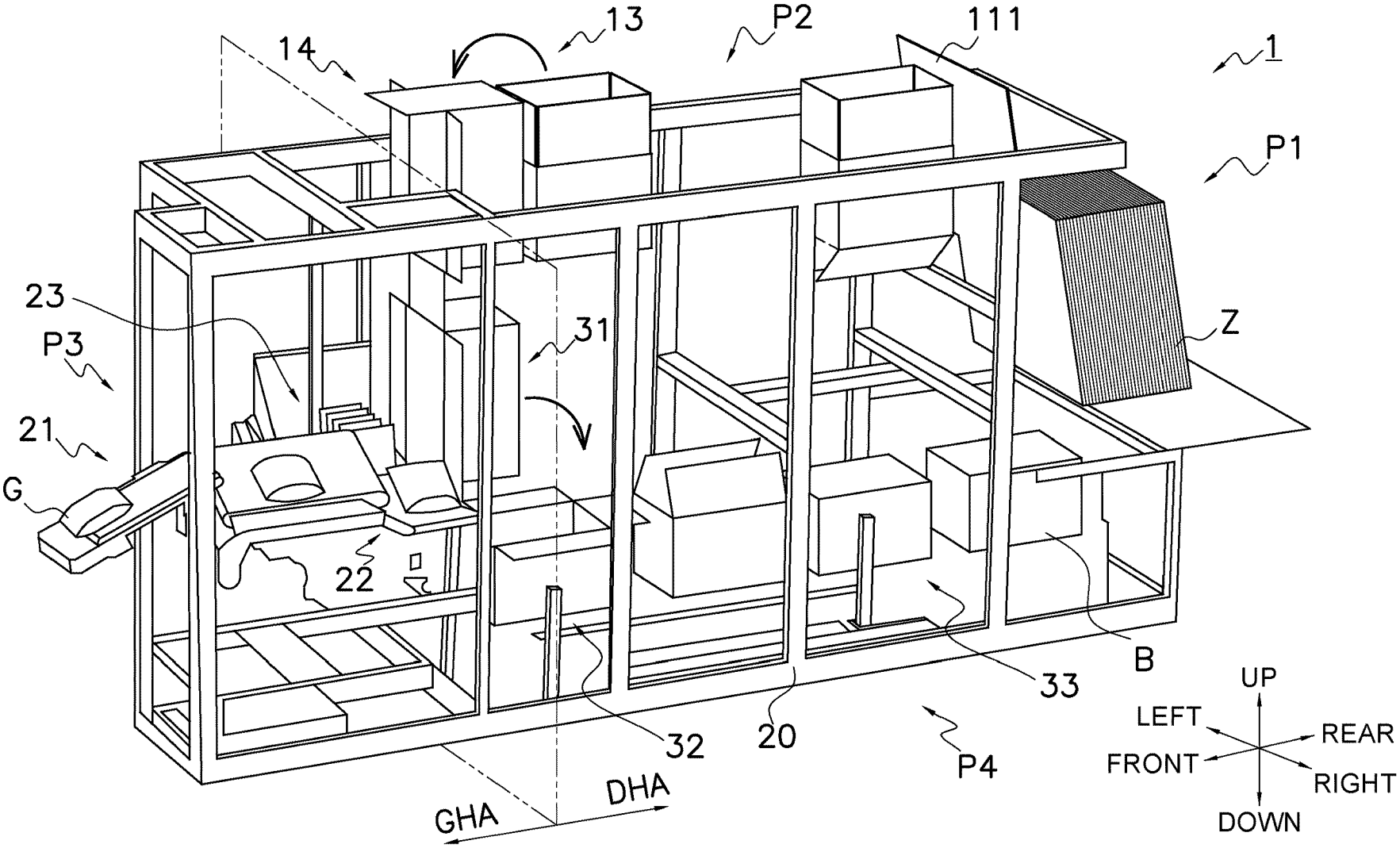
FIG. 2 is a perspective view of the configuration of the box-packing system.
Figure 3:
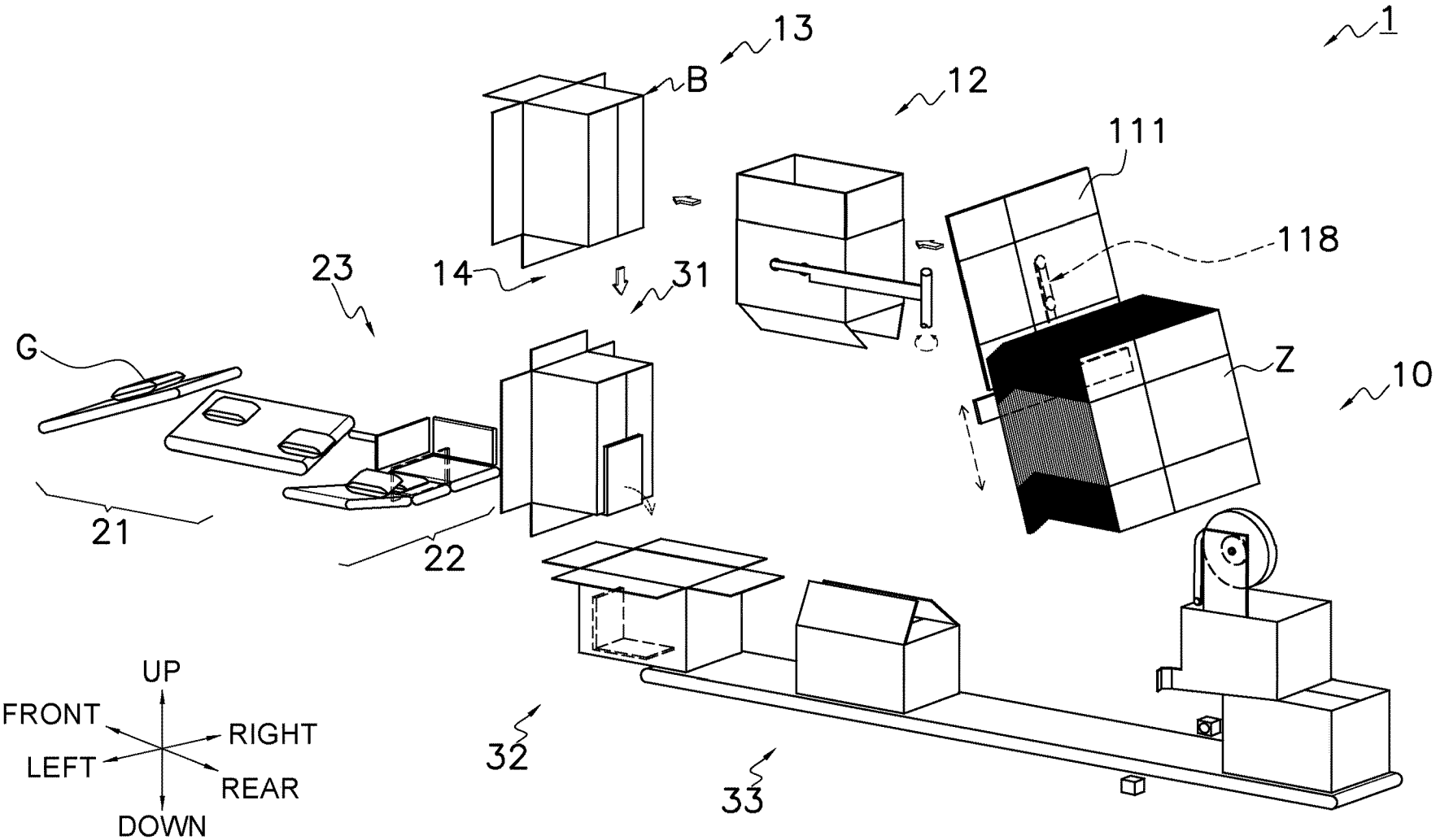
FIG. 3 is a perspective view of the flow of corrugated cardboard boxes and goods in the box-packing system.

FIG. 2 is a perspective view of the configuration of the box-packing system 1 equipped with the supply apparatus 10 according to one embodiment of the present invention, and FIG. 3 is a perspective view of the flow of corrugated cardboard boxes B and goods G in the box-packing system 1.

The box-packing system 1 packs corrugated cardboard boxes B with multiple layers of bagged goods (goods G), e.g., snack food, in fixed quantities and in an orderly arrangement, as shown in FIGS. 2 and 3.

In the box-packing system 1, a cardboard-handling area DHA and a goods-handling area GHA are independently and separably connected to each other, as shown in FIGS. 2 and 3. The cardboard-handling area DHA includes three steps: a supply step P1, a box-making step P2, and a box-packing step P4. The goods-handling area GHA includes a goods-arranging step P3.

In other words, due to the cardboard-handling area DHA and the goods-handling area GHA being connected in the box-packing system 1, four steps are aligned: the supply step P1, the box-making step P2, the goods-arranging step P3, and the box-packing step P4.

The supply step P1 is a process in which a corrugated cardboard sheet Z is conveyed to a predetermined supply position SP, and the supply step P1 is configured from the supply apparatus 10.

The box-making step P2 is a process in which the corrugated cardboard sheet Z is assembled into a corrugated cardboard box B and the resulting box is conveyed to a box-packing position, and is carried out by a box-making section 12 (equivalent to the box-making apparatus described in the claims), a first orientation-changing section 13, and a box-downward-conveying unit 14.

The goods-arranging step P3 is a process in which goods G supplied from an upstream step are conveyed to a predetermined position, a fixed number of goods G are arrayed so that adjacent goods partially stack on top of each other, and the goods are conveyed to a box-packing position. The goods-arranging step P3 is carried out by a goods-convey-in section 21, a goods-arranging section 22, and a goods-inserting section 23.

The box-packing step P4 is a process in which the corrugated cardboard box B conveyed from the box-making step P2 is packed with a fixed number of goods G that have been arrayed in the goods-arranging step P3, and the box is closed and conveyed to a box-ejecting position. The box-packing step P4 is carried out by a goods-receiving section 31, a second orientation-changing section 32, and a box-sealing section 33.

The box-making step P2, the goods-arranging step P3, and the box-packing step P4 are already known processes, and shall therefore not be described here. The supply step P1 is described in detail below.

(2) Actions of Sections in Supply Step P1

The supply step P1 is described with reference to FIGS. 4 and 5. As described above, the supply step P1 is a step in which a corrugated cardboard sheet Z is supplied to a predetermined supply position SP. The supply step P1 is realized by the supply apparatus 10 acting under control by the controller 40 (see FIG. 1).

Figure 4:
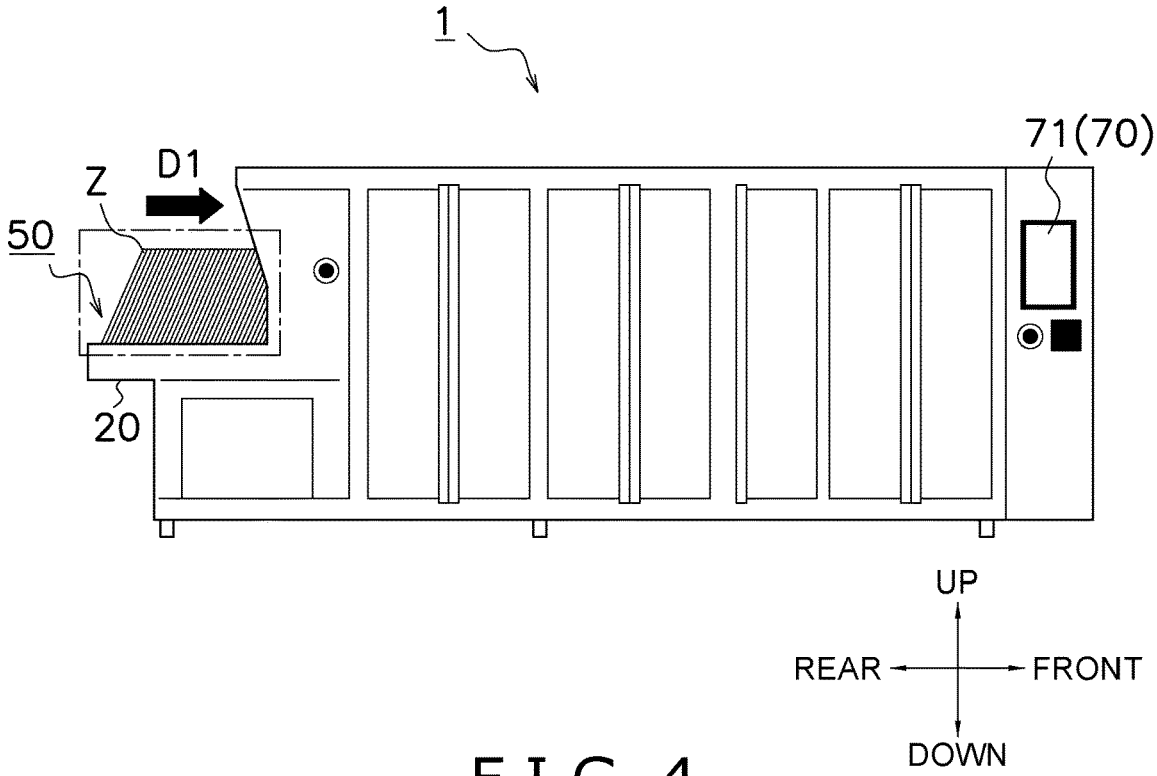
FIG. 4 is a schematic side view of the box-packing system.

FIG. 4 is a schematic side view of the box-packing system 1 equipped with the supply apparatus 10. FIG. 5 is an enlarged view of the area encircled by the single-dash lines in FIG. 4. In FIG. 5, a frame 20 of the box-packing system 1 is only partially depicted in order to make the description easier to comprehend. A plurality of corrugated cardboard sheets Z are placed in a stacked state on a conveying unit 50 of the supply apparatus 10 as shown in FIGS. 4 and 5. More specifically, a plurality of corrugated cardboard sheets Z oriented upright so that sheet surfaces ZS (outer surfaces of the corrugated cardboard sheets Z) are inclined relative to horizontal are placed in a stacked state on the conveying unit 50. In addition, lower ends of the corrugated cardboard sheets Z constituting the plurality of stacked corrugated cardboard sheets Z is in contact with a conveying surface 53*a* as shown in FIGS. 4 and 5. In short, a plurality of stacked corrugated cardboard sheets Z is vertically placed in a forward incline on the conveying unit 50. In the present embodiment, the plurality of stacked corrugated cardboard sheets Z vertically placed in a forward incline are sometimes referred to as the "plurality of stacked corrugated cardboard sheets Z."

Figure 5:
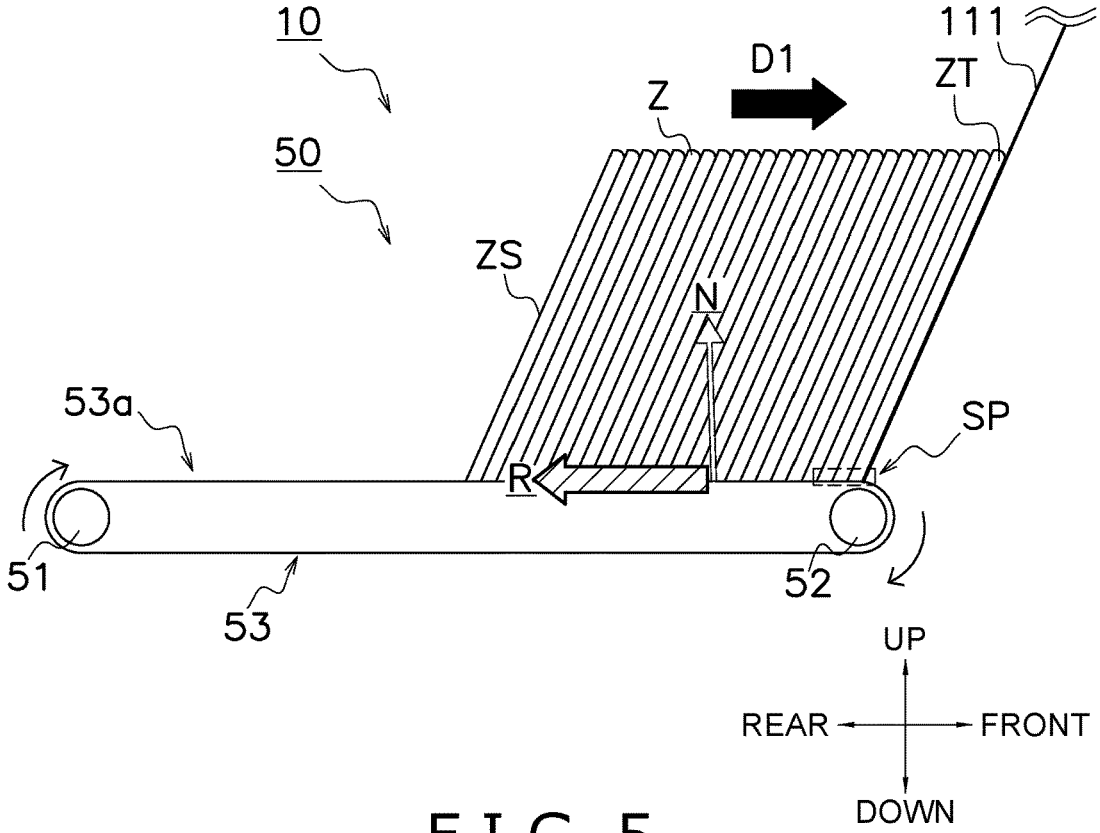
FIG. 5 is a schematic side view of the supply apparatus.

The supply apparatus 10 is provided with the conveying unit 50, a drive unit 60, and a notification unit 70, as shown in FIG. 5. In the supply apparatus 10, the drive unit 60 drives the conveying unit 50, whereby the plurality of stacked corrugated cardboard sheets Z is conveyed.

(2-1) Conveying Unit 50

The conveying unit 50 is a conveyor that conveys the plurality of stacked corrugated cardboard sheets Z to the supply position SP. The conveying unit 50 according to the present embodiment also serves as an accumulation unit for accumulating the corrugated cardboard sheets Z supplied to the box-packing system 1.

The conveying unit 50 is a belt conveyor including a drive roller 51, a driven roller 52, and an endless belt 53, as shown in FIG. 5. The belt 53 is wound around the drive roller 51 and the driven roller 52. The drive roller 51 rotates by being driven by the drive unit 60. By rotating, the drive roller 51 drives the belt 53. The plurality of corrugated cardboard sheets Z placed on the conveying surface 53*a* of the belt 53 are conveyed due to the belt 53 being driven. The conveying unit 50 conveys the plurality of corrugated cardboard sheets Z in a conveying direction D1 (see the arrows in FIGS. 4 and 5). An inclined surface 111 is present in the conveying direction D1 (see FIG. 5). The inclined surface 111 is a surface that is tilted relative to vertical and is disposed such that the upper side is forward (a surface tilted forward), as shown in FIG. 5. The movement of the plurality of corrugated cardboard sheets Z in the conveying direction D1 is regulated by the inclined surface 111. Therefore, when the belt 53 is driven and conveying force in the conveying direction D1 acts on the lower parts of the plurality of corrugated cardboard sheets Z, the plurality of corrugated cardboard sheets Z stack on top of each other on the conveying surface 53*a*. Of the plurality of stacked corrugated cardboard sheets Z, several corrugated cardboard sheets Z positioned at the leading side in the conveying direction D1 reach the supply position SP (refer to the area encircled by the double-dash lines shown in FIG. 5) at this time. The several corrugated cardboard sheets Z that have reached the supply position SP are fed out to the box-making section 12 by a sheet-moving unit 118.

(2-1-1) Sheet-Moving Unit 118

The sheet-moving unit 118 of the box-packing system 1 shall now be described. The sheet-moving unit 118 is an apparatus that takes one corrugated cardboard sheet Z from the plurality of stacked corrugated cardboard sheets Z accumulated on the conveying unit 50 and supplies that one corrugated cardboard sheet Z to the box-making section 12 (see FIG. 3). For example, the sheet-moving unit 118 uses a suction cup (not shown) to hold the corrugated cardboard sheet Z accumulated on the conveying unit 50 and feeds the corrugated cardboard sheet Z out to the box-making section 12 by moving the suction cup with the sheet held thereon. Specifically, of the plurality of stacked corrugated cardboard sheets Z accumulated on the conveying unit 50, the forwardmost corrugated cardboard sheet Z in the conveying direction D1 is held and fed out by the sheet-moving unit 118 to the box-making section 12 located upward and forward.

For convenience of description below, of the plurality of stacked corrugated cardboard sheets Z, the corrugated cardboard sheet Z located at the forwardmost position in the conveying direction D1 is sometimes referred to as the "leading corrugated cardboard sheet ZT." In addition, the action performed by the 118 of feeding one corrugated cardboard sheet Z out to the box-making section 12 is sometimes referred to below as the "feed-out action."

As described above, in the box-packing system 1 according to the present embodiment, at most ten corrugated cardboard boxes B are packed every minute. In other words, the box-packing system 1 can be set so as to operate at the setting "10 boxes/min." When the box-packing system 1 is set so as to operate at the setting "10 boxes/min," the sheet-moving unit 118 feeds one corrugated cardboard sheet Z out to the box-making section 12 every six seconds.

In the supply step P1 according to the present embodiment, the conveying unit 50 conveys a plurality of stacked corrugated cardboard sheets Z in the conveying direction D1 with every three feed-out actions performed by the sheet-moving unit 118. Information is provided in greater detail further below.

(2-2) Drive Unit 60

The drive unit 60 according to the present embodiment is a motor that drives the conveying unit 50. Due to the drive unit 60 driving the conveying unit 50, the corrugated cardboard sheets Z are conveyed to the supply position SP.

The drive unit 60 according to the present embodiment performs an intermittent operation in the supply step P1. Specifically, the drive unit 60 drives the conveying unit 50 for 1 second with every three feed-out actions performed by the sheet-moving unit 118. In other words, the drive unit 60 stops the driving of the conveying unit 50 while the feed-out action is being performed by the sheet-moving unit 118 (for example, for 18 seconds), and drives the conveying unit 50 for 1 seconds when the sheet-moving unit 118 feeds out the third corrugated cardboard sheet Z.

Figure 6A:
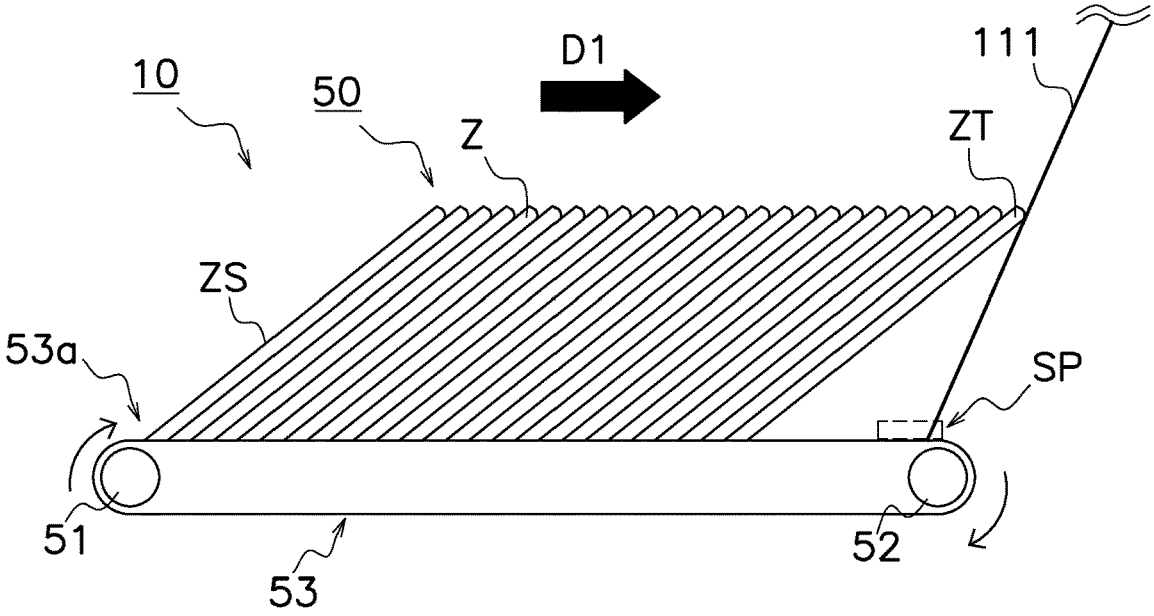
FIGS. 6A and 6B are each a schematic side view of the supply apparatus.
Figure 6B:
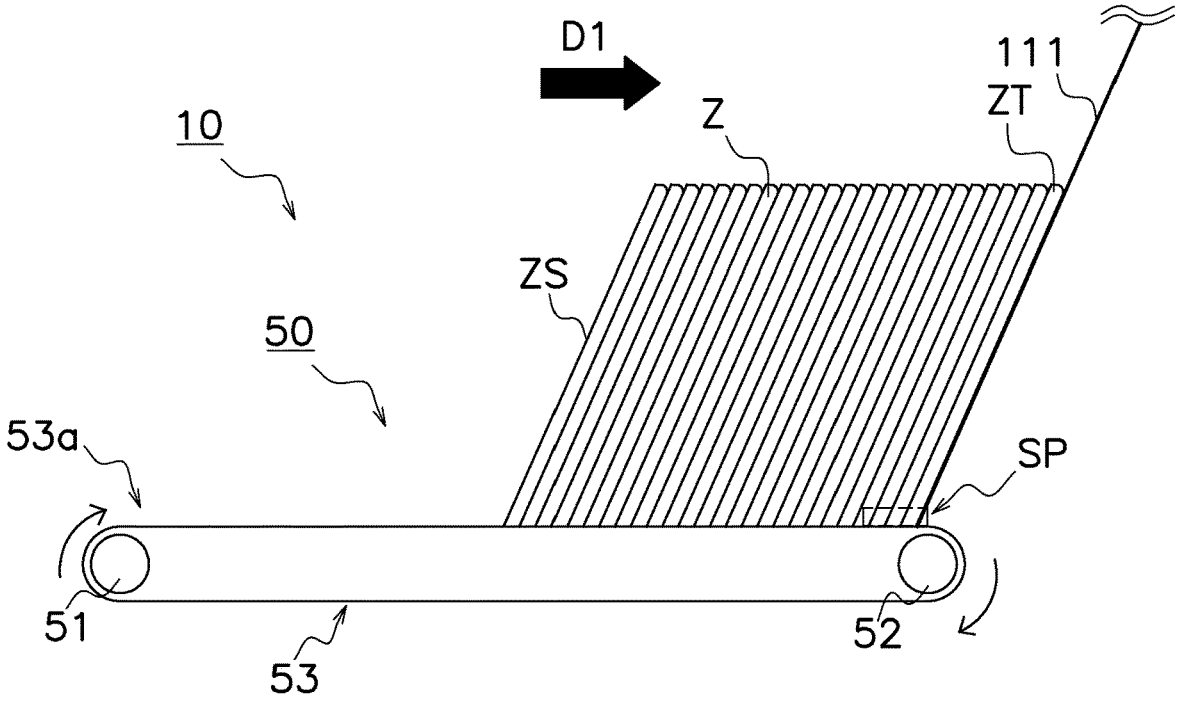

Due to the drive unit 60 performing an intermittent operation as described above, the lower parts of the plurality of stacked corrugated cardboard sheets Z move in the conveying direction D1 by a distance equal to the thickness of a number of corrugated cardboard sheets Z fed out by the sheet-moving unit 118 (see FIG. 6A and FIG. 6B). The leading corrugated cardboard sheet ZT thereby comes into contact with the inclined surface 111 so as to lie along said surface (see FIG. 6B). An idling operation is performed by the drive unit 60 at this time. An idling operation is operation in which the drive unit 60 drives the conveying unit 50 while the leading corrugated cardboard sheet ZT is in contact with the inclined surface 111 so as to lie along said surface. In an idling operation, the drive roller 51, the driven roller 52, and the belt 53 remain idle while the plurality of stacked corrugated cardboard sheets Z rests on the conveying surface 53*a*. To summarize the above, in 1 second, the drive unit 60 according to the present embodiment moves the lower parts of a plurality of stacked corrugated cardboard sheets Z in the conveying direction D1 and performs an idling operation.

The action of the box-packing system 1 in the supply step P1 continues until the total quantity (remaining amount) of the plurality of stacked corrugated cardboard sheets Z carried on the conveying surface 53*a* is estimated by the controller 40 to be less than a predetermined value. The method by which the controller 40 estimates the total quantity of the plurality of stacked corrugated cardboard sheets Z shall be described hereinafter. The controller 40 causes the notification unit 70 to issue a notification upon estimating that the total quantity of the plurality of stacked corrugated cardboard sheets Z is less than the predetermined value.

(2-3) Notification Unit 70

The notification unit 70 according to the present embodiment is a liquid crystal display 71 that can display a variety of information relating to the supply apparatus 10 (see FIG. 4). The liquid crystal display 71 is not provided by way of limitation as to the configuration of the notification unit 70; the notification unit 70 may be an LED lamp, a speaker, etc. The liquid crystal display 71 serving as the notification unit 70 is electrically connected to the controller 40 by wire or wirelessly. The liquid crystal display 71 can therefore send and receive signals and a variety of information to and from the controller 40. When a predetermined signal is sent from the controller 40, the liquid crystal display 71 issues a notification of information prompting an operator of the supply apparatus 10 to replenish the corrugated cardboard sheets Z. For example, the liquid crystal display 71 displays warning text indicating the corrugated cardboard sheets Z need to be replenished as information prompting replenishment of the corrugated cardboard sheet Z.

(3) Controller 40

The configuration of the controller 40 according to the present embodiment shall now be described in detail.

The controller 40 controls the actions of the parts constituting the box-packing system 1 including the supply apparatus 10, as shown in FIG. 1.

The controller 40 is electrically connected to the parts of the box-packing system 1 by wire or wirelessly so as to be capable of sending and receiving control signals, information, etc. The controller 40 is realized using a computer. The controller 40 is provided with a control computation device and a storage device. A processor such as a CPU or a GPU can be used as the control computation device. The control computation device reads a program stored in the storage device and performs a predetermined computation process in accordance with this program. Furthermore, the control computation device can, write a computation result into the storage device and read information stored in the storage device in accordance with the program. ROM, RAM, or another type of memory can be used as the storage device. The storage device stores programs for controlling the actions of the parts of the box-packing system 1, communication protocols used when the box-packing system 1 communicates with other equipment, etc. In addition, the storage device stores a predetermined relational expression indicating a relationship between a value pertaining to the drive force of the drive unit 60 and the total quantity of the plurality of stacked corrugated cardboard sheets Z.

FIG. 1 shows a functional block realized by the control computation device. As shown in FIG. 1, the controller 40 has a function as a total quantity estimation unit 41. The controller 40 performs a process relating to manual replenishment of the corrugated cardboard sheets Z on the basis of the total quantity of the corrugated cardboard sheets Z estimated by the function of the total quantity estimation unit 41. For example, the controller 40 performs a process that causes the notification unit 70 to issue a notification of information prompting replenishment of the corrugated cardboard sheets Z.

(3-1) Total Quantity Estimation Unit 41

The total quantity estimation unit 41 is a functional unit that estimates the total quantity of the plurality of stacked corrugated cardboard sheets Z on the basis of a value pertaining to the drive force of the drive unit 60.

The inventors associated with the present application have discovered that the value pertaining to the drive force of the drive unit 60 has a correlation with the total quantity of the plurality of stacked corrugated cardboard sheets Z placed on the conveying surface 53*a* of the conveying unit 50. In other words, the inventors associated with the present application have discovered that a predetermined relational expression holds between the value pertaining to the drive force of the drive unit 60 and the total quantity of the plurality of stacked corrugated cardboard sheets Z. From this matter, the inventors associated with the present application have discovered that the total quantity of the plurality of stacked corrugated cardboard sheets Z can be estimated on the basis of the value pertaining to the drive force of the drive unit 60. Information is provided in greater detail further below.

(3-2) Method for Estimating Number of Plurality of Stacked Corrugated Cardboard Sheets Z As a premise, it is assumed in the following description that the coefficient of dynamic friction between the belt 53 of the conveying unit 50 and the corrugated cardboard sheet Z is the same. In this example, a torque value is used as the value pertaining to the drive force of the drive unit 60 (a motor or the like). As described above, the controller 40 is electrically connected by wire or wirelessly to the parts constituting the box-packing system 1 so as to be able to send and receive control signals, information, etc., to and from said parts. Therefore, the controller 40 can acquire a torque value from the drive unit 60.

As previously described, the supply apparatus 10 has a conveying unit 50. When the conveying unit 50 carrying a plurality of stacked corrugated cardboard sheets Z is actuated at a constant velocity, a dynamic friction force R received by the conveying unit 50 changes depending on a perpendicular drag force N. It is assumed that the magnitude of the perpendicular drag force N changes according to the total quantity of the plurality of stacked corrugated cardboard sheets Z placed on the conveying unit 50. This is because the weight of the plurality of stacked corrugated cardboard sheets Z changes according to the total quantity of the plurality of stacked corrugated cardboard sheets Z. From this it is assumed that when the conveying unit 50 is driven while the conveying velocity is kept constant, the dynamic friction force R changes depending on the total quantity of the plurality of stacked corrugated cardboard sheets Z. Specifically, it is assumed that the dynamic friction force R increases if the total quantity of the plurality of stacked corrugated cardboard sheets Z increases, and the dynamic friction force R decreases if the total quantity of the plurality of stacked corrugated cardboard sheets Z decreases. The change in the dynamic friction force R is reflected in the value (a torque value in this example) pertaining to the drive force of the drive unit 60. In particular, the dynamic friction force R is accurately reflected in the torque value because the stacked corrugated cardboard sheets Z according to the present embodiment are in contact at the lower ends with the conveying surface 53*a*.

Thus, there is a correlation between the torque value and the total quantity of the plurality of stacked corrugated cardboard sheets Z. Therefore, the total quantity estimation unit 41 can estimate the total quantity of the plurality of stacked corrugated cardboard sheets Z by inputting the torque value acquired by the controller 40 into a predetermined estimation expression stored in the storage device. Specifically, the total quantity estimation unit 41 can estimate the total quantity of the plurality of stacked corrugated cardboard sheets Z within an error range of about ±5 sheets.

To estimate the total quantity of the plurality of stacked corrugated cardboard sheets Z, it is preferable to acquire a torque value that more accurately reflects the dynamic friction force R. Therefore, the controller 40 preferably acquires the torque value when the idling operation is performed.

(4) Overall Action in Supply Step P1

(4-1)

Figure 7:
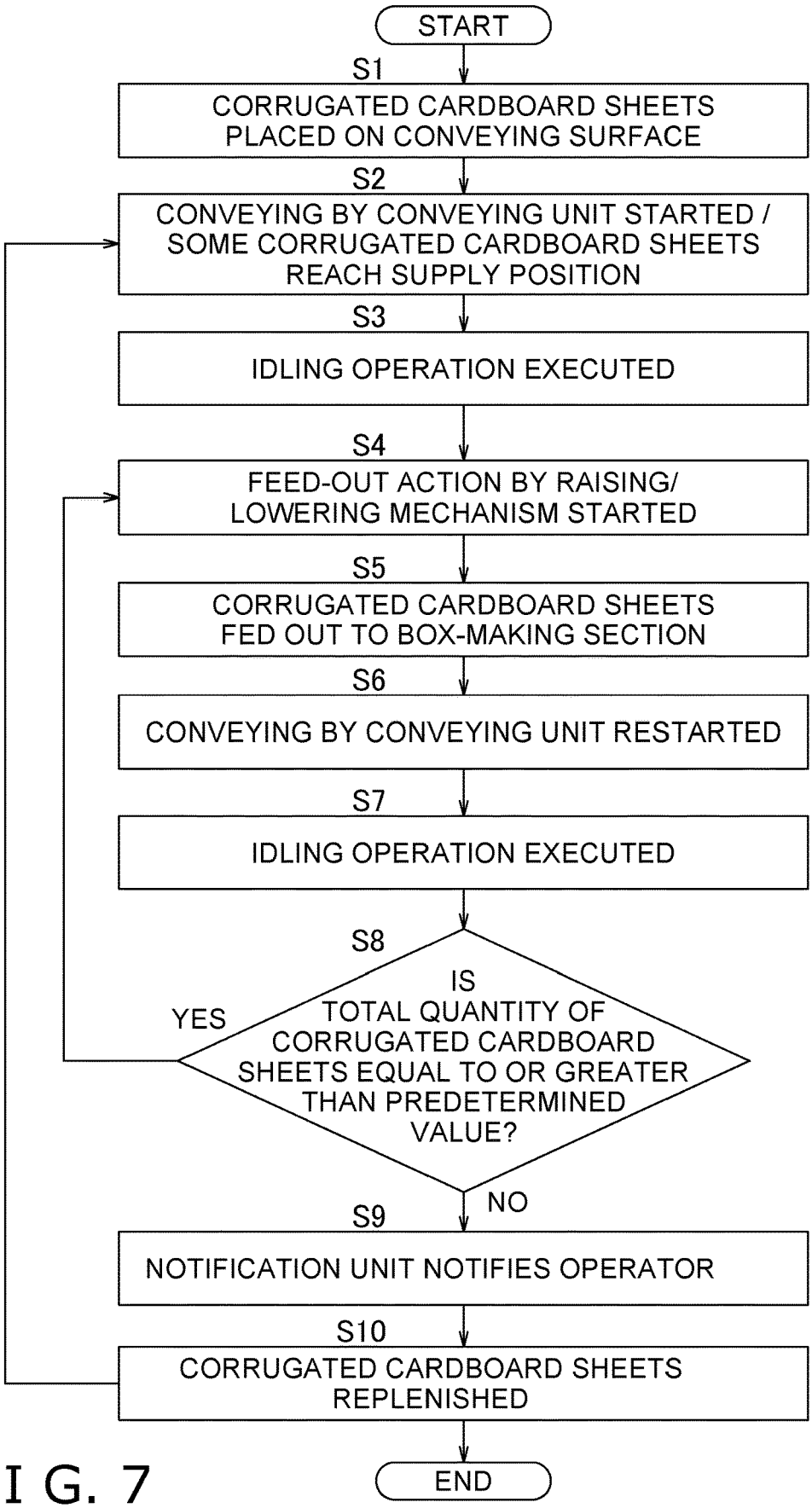
FIG. 7 is a flow chart of the flow of actions performed in a supply process.

The overall action performed in the supply step P1 of the box-packing system 1 shall now be described using the flowchart shown in FIG. 7. The box-packing system 1 provided with the supply apparatus 10 performs the supply step P1 with a flow such as is shown in steps S1 to S11 in FIG. 7. The flow of actions shown in FIG. 7 is one example and can be changed as appropriate. For example, the order of the steps may be changed within a consistent range, some steps may be executed in parallel with other steps, and other steps may be newly added.

(4-2)

In step S1, the operator lays the plurality of stacked corrugated cardboard sheets Z on the conveying surface 53*a* by hand. For example, the plurality of stacked corrugated cardboard sheets Z is placed on the conveying surface 53*a* in a posture so as to lean against the inclined surface 111 (a posture such as is shown in FIG. 6A).

In step S2, the plurality of stacked corrugated cardboard sheets Z is conveyed by the conveying unit 50 in the conveying direction D1. As a consequence, the leading corrugated cardboard sheet ZT comes into contact with the inclined surface 111 so as to lie along the inclined surface 111 (see FIG. 6B). At this time, several corrugated cardboard sheets Z positioned at the leading side of the plurality of stacked corrugated cardboard sheets Z reach the supply position SP.

In step S3, the idling operation is performed.

In step S4, the sheet-moving unit 118 initiates a feed-out action.

In step S5, a plurality of (three in this example) corrugated cardboard sheets Z are fed out to the box-making section 12 by the feed-out action of the sheet-moving unit 118. The plurality of stacked corrugated cardboard sheets Z is thereby inclined so as to be in a nearly horizontal posture in relation to the conveying surface 53*a*. Specifically, the plurality of stacked corrugated cardboard sheets Z assumes a posture similar to the posture in step S1.

In step S6, the drive unit 60 drives the conveying unit 50. As a consequence, the leading corrugated cardboard sheet ZT comes into contact with the inclined surface 111 so as to lie along the inclined surface 111. At this time, the plurality of stacked corrugated cardboard sheets Z assumes a posture similar to the posture in step S2.

In step S7, the idling operation is performed.

In step S8, the controller 40 estimates the total quantity of the plurality of stacked corrugated cardboard sheets Z. When the total quantity of the plurality of stacked corrugated cardboard sheets Z is equal to or greater than a predetermined value in step S8, the action in the supply step P1 returns to step S4. When the total quantity of the plurality of stacked corrugated cardboard sheets Z is less than the predetermined value in step S8, the action in the supply step P1 advances to step S9.

In step S9, the notification unit 70 issues to the operator of the supply apparatus 10 a notification of information prompting the operator to replenish the corrugated cardboard sheets Z.

In step S10, the operator replenishes the corrugated cardboard sheets Z. When the controller 40 has detected in step S10 that the corrugated cardboard sheets Z have been replenished, the action in the supply step P1 returns to step S2.

In this manner, the box-packing system 1 equipped with the supply apparatus 10 performs the supply step P1. The actions described above continue until the operator inputs an operation stop command to the supply apparatus 10 or the box-packing system 1. Alternatively, the actions described above continue until the number of corrugated cardboard sheets Z supplied to the box-packing system 1 reach a target supply number stored in advance in a predetermined storage area of the storage device.

(5) Characteristics

Apparatuses that make, pack, and seal boxes are known in the prior art, as is disclosed in Japanese Laid-open Patent Publication No. 2019-147582. Such apparatuses are assumed to be equipped with a supply apparatus that supplies a plurality of stacked corrugated cardboard sheets to a box-making section. In some cases, the supply apparatus includes a photoelectric sensor for sensing the total quantity of the plurality of stacked corrugated cardboard sheets.

When an expensive sensor is employed as the photoelectric sensor included in the supply apparatus, the cost of manufacturing the supply apparatus may increase.

Figure 10:
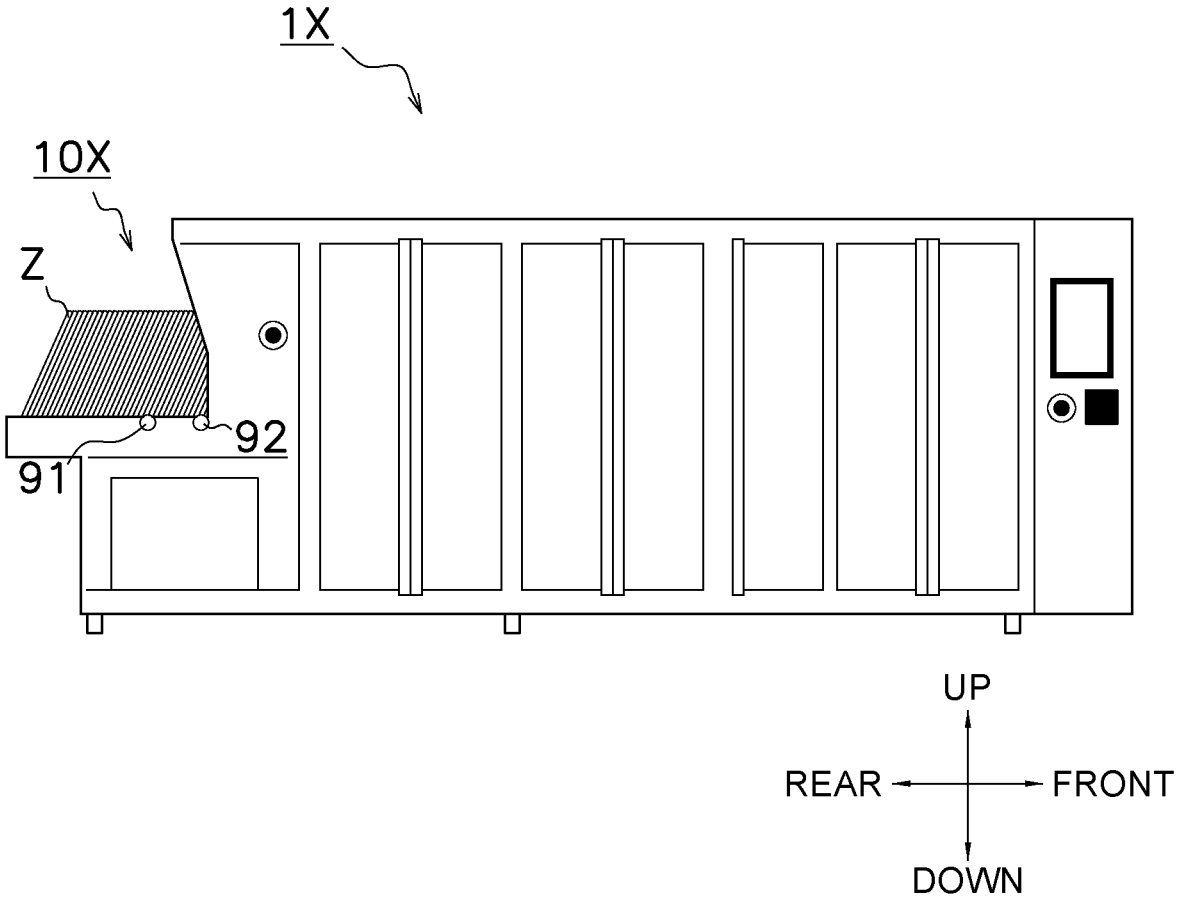
PRIOR ART F I G. 10
FIG. 10 is a schematic side view of a supply apparatus according to the prior art.

An alternative option is for the total quantity of the plurality of stacked corrugated cardboard sheets to be sensed using an inexpensive photoelectric sensor. For example, the total quantity of the plurality of stacked corrugated cardboard sheets could be sensed by means of a configuration such as is shown in FIG. 10. FIG. 10 is a schematic side view of a box-packing system 1X comprising a supply apparatus 10X according to the prior art. The supply apparatus 10X is provided with a first sensor 91 and a second sensor 92 as photoelectric sensors. The supply apparatus 10X detects that there is a large amount of corrugated cardboard sheets Z when the first sensor 91 and the second sensor 92 are shielded from light. The supply apparatus 10X detects that the total quantity of corrugated cardboard sheets Z is small when the first sensor 91 is exposed to light and the second sensor 92 shielded from light. The supply apparatus 10X detects that the total quantity of corrugated cardboard sheets Z is exceedingly small when the first sensor 91 and the second sensor 92 are both exposed to light. However, the remaining amount of corrugated cardboard sheets Z can only be detected in increments with the configuration of the supply apparatus 10X. Therefore, it is difficult with the supply apparatus 10X to perform an action of, for example, prompting (notifying) the operator at the proper timing to replenish the corrugated cardboard sheets Z. Regarding this point, it is conceivable that detection precision could be improved by increasing the number of photoelectric sensors installed, but such a measure may lead to an increase in the cost of manufacturing the supply apparatus.

(5-1)

The supply apparatus 10 according to the present embodiment is a supply apparatus 10 that supplies corrugated cardboard sheets Z to a supply position SP in a box-making section 12 that opens folded corrugated cardboard sheets Z and makes boxes. The supply apparatus 10 comprises a conveying unit 50, a drive unit 60, and a control unit 40. The conveying unit 50 conveys a plurality of the corrugated cardboard sheets Z to the supply position SP with the corrugated cardboard sheets Z stacked. The drive unit 60 drives the conveying unit 50. A controller 40, which serves as the control unit, estimates the total quantity of the plurality of stacked corrugated cardboard sheets Z on a conveying surface 53*a* of the conveying unit 50. The controller 40 acquires a value pertaining to the drive force of the drive unit 60 when the drive unit 60 drives the conveying unit 50, and estimates the total quantity of the plurality of stacked corrugated cardboard sheets Z on the basis of the acquired value.

In the supply apparatus 10 according to the present embodiment, the controller 40 estimates the total quantity of the plurality of stacked corrugated cardboard sheets Z on the basis of the value pertaining to the drive force of the drive unit 60. Thus, in the supply apparatus 10 according to the present embodiment, the total quantity of the plurality of stacked corrugated cardboard sheets Z is estimated without using a sensor. Therefore, in the supply apparatus 10 according to the present embodiment, the total quantity of the plurality of stacked corrugated cardboard sheets Z can be estimated by means of an inexpensive configuration.

In addition, in the supply apparatus 10 according to the present embodiment, the controller 40 can estimate the total quantity of the plurality of stacked corrugated cardboard sheets Z more precisely than in cases of using an inexpensive photoelectric sensor.

(5-2)

In the supply apparatus 10 according to the present embodiment, the controller 40, on the basis of the estimated total quantity of the plurality of corrugated cardboard sheets Z, performs a process relating to manually replenishing the corrugated cardboard sheets Z.

For example, the supply apparatus 10 performs a process relating to manually replenishing the corrugated cardboard sheets Z when the total quantity of corrugated cardboard sheets Z is less than a predetermined value. According to this configuration, the operator of the supply apparatus 10 will not have to monitor the supply apparatus 10 any more than necessary. Therefore, with the supply apparatus 10 according to the present embodiment, operator labor can be reduced.

(5-3)

The supply apparatus 10 according to the present embodiment further comprises a notification unit 70. The notification unit 70 issues a notification of information prompting replenishing the corrugated cardboard sheets Z. The controller 40 performs a process of causing the notification unit 70 to perform notification.

According to this configuration, the operator of the supply apparatus 10 will not have to monitor the supply apparatus 10 any more than necessary.

As described above, in the supply apparatus 10 according to the present embodiment, the controller 40 can estimate the total quantity of the plurality of stacked corrugated cardboard sheets Z more precisely than in cases of using an inexpensive photoelectric sensor. Therefore, in the supply apparatus 10 according to the present embodiment, notification to replenish the corrugated cardboard sheets Z can be issued at a precise timing. Accordingly, operator labor is reduced with the supply apparatus 10 according to the present embodiment.

As described above, with the supply apparatus 10 according to the present embodiment, the total quantity of corrugated cardboard sheets Z can be estimated within an error range of about ±5 sheets. Therefore, the supply apparatus 10 according to the present embodiment can notify the operator of specific information, for example, indicating "how many more corrugated cardboard sheets Z need to be replenished." Having received the notification of this information, the operator can prepare the proper number of corrugated cardboard sheets Z. Therefore, operator labor can be reduced.

(5-4)

In the supply apparatus 10 according to the present embodiment, the controller 40 can estimate the total quantity of the plurality of stacked corrugated cardboard sheets Z on the basis of a relational expression for the value pertaining to the drive force of the drive unit 60 and the total quantity of the plurality of stacked corrugated cardboard sheets Z.

In this case, the total quantity of the plurality of stacked corrugated cardboard sheets Z is estimated on the basis of an easily acquirable value; namely, the torque value of the drive unit 60, as the value pertaining to the drive force of the drive unit 60. In other words, the total quantity of the plurality of stacked corrugated cardboard sheets Z is estimated on the basis of a value that can be acquired without using a special sensor or the like. Accordingly, any increase in the cost of manufacturing the supply apparatus 10 is suppressed.

(5-5)

In the supply apparatus 10 according to the present embodiment, the plurality of stacked corrugated cardboard sheets Z is placed on the conveying surface 53*a* in a state of being inclined relative to horizontal. The plurality of stacked corrugated cardboard sheets Z is conveyed in a state such that the lower ends of the plurality of stacked corrugated cardboard sheets Z is in contact with the conveying surface 53*a*.

According to this configuration, the dynamic friction force R is more accurately reflected in the value pertaining to the drive force of the drive unit 60. Therefore, in the supply apparatus 10 according to the present embodiment, the total quantity estimation unit 41 can estimate the total quantity of the plurality of stacked corrugated cardboard sheets Z with greater precision.

(6) Modifications

The above embodiment can be modified as appropriate as shown in the following modifications. The modifications may be applied in combination with other modifications as long as there is no contradiction. The same components as those in the first embodiment are designated by the same reference numerals and are not described in detail.

(6-1) Modification 1A

A description was given in the above embodiment of the control unit 40 performing a process of manually replenishing the corrugated cardboard sheets Z on the basis of the estimated total quantity of the plurality of corrugated cardboard sheets Z. However, this example is not provided by way of limitation as to the configuration of the controller 40 according to the present invention; the controller 40 may, for example, perform a process relating to an action of automatically replenishing the corrugated cardboard sheets Z.

A supply apparatus 10 according to Modification 1A shall now be described with reference to FIG. 8. The supply apparatus 10 according to the present modification comprises a sheet supply apparatus 200 in addition to the configuration of the supply apparatus 10 described in the above embodiment. Alternatively, the sheet supply apparatus 200 may be provided in the box-packing system 1.

Figure 8:
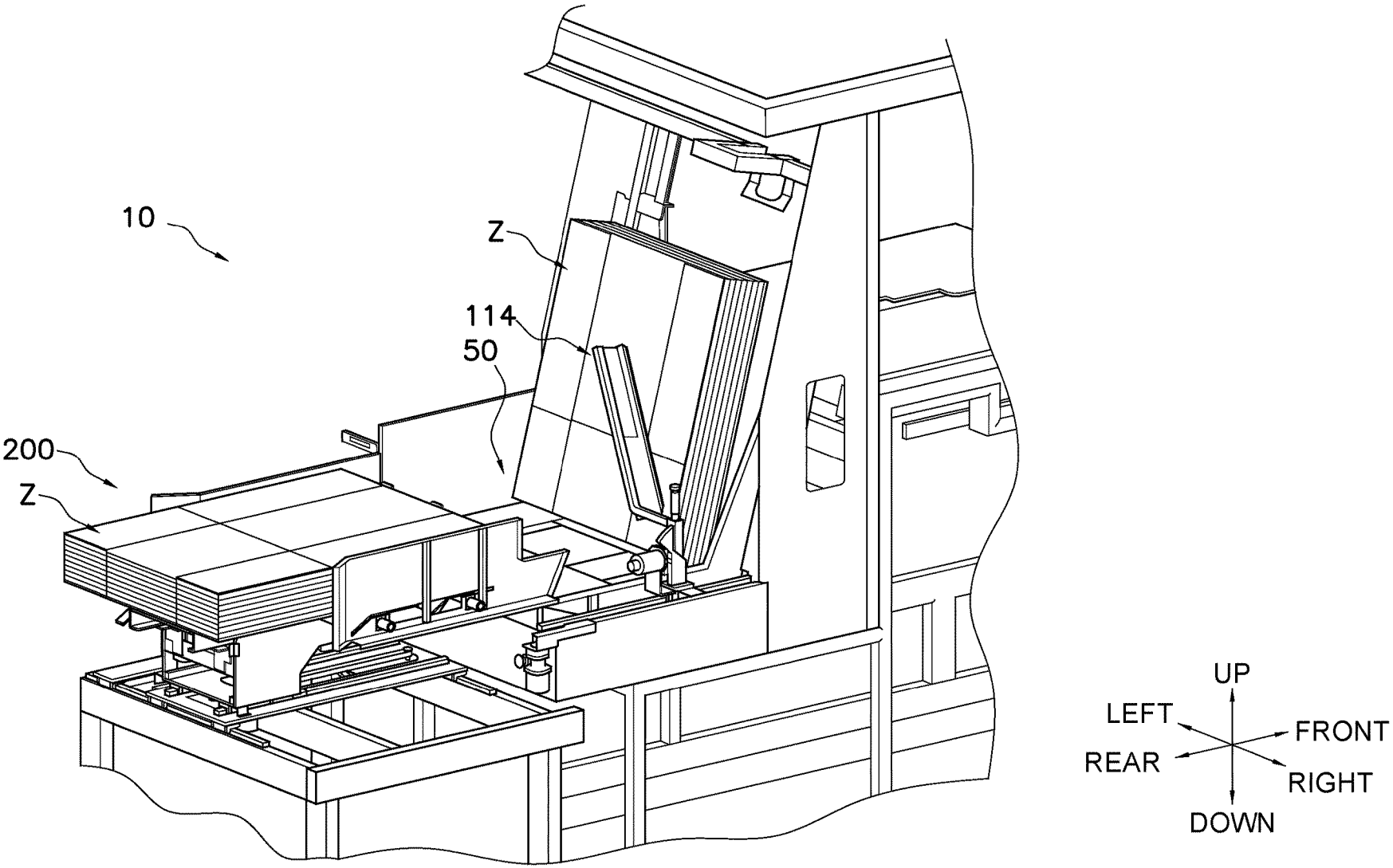
FIG. 8 is a perspective view of a supply apparatus according to a modification.

The sheet supply apparatus 200 shown in FIG. 8 is an apparatus that collectively supplies corrugated cardboard sheets Z to the conveying unit 50. The sheet supply apparatus 200 is installed behind and adjacent to the conveying unit 50 (see FIG. 8). The sheet supply apparatus 200 receives from the exterior a plurality of corrugated cardboard sheets Z laid down such that sheet surfaces ZS are horizontal, and supplies the corrugated cardboard sheets Z to the supply apparatus 10 after having changed the posture of the corrugated cardboard sheets Z to standing. For example, a conveyor or an unmanned conveying vehicle (not shown) supplies the corrugated cardboard sheets Z to the sheet supply apparatus 200.

In the supply apparatus 10 according to the present modification, the controller 40, on the basis of the estimated total quantity of the plurality of corrugated cardboard sheets Z, performs a process relating to an action of automatically replenishing the corrugated cardboard sheets Z. More specifically, the controller 40 transmits a control signal to the sheet supply apparatus 200 when the estimated total quantity of the plurality of corrugated cardboard sheets Z is less than a predetermined value. Having received the control signal, the sheet supply apparatus 200 supplies the corrugated cardboard sheets Z to the supply apparatus 10.

With the supply apparatus 10 according to the present modification, operator labor is further reduced.

(6-2) Modification 1B

Although a description is omitted in the above embodiment, it is conceivable that there could be mechanical differences between supply apparatuses 10. For example, it is conceivable that the tension in the belt 53 of a supply apparatus 10 used in one factory and the tension in the belt 53 of a supply apparatus 10 used in another factory could be different. Such a mechanical difference could possibly affect the torque value of the drive unit 60, and may consequently affect the precision of the estimation made by the total quantity estimation unit 41. Therefore, a trial operation is preferably performed before the operation of the supply apparatus 10 is started. In a trail operation, it is preferable to measure the torque value when the conveying unit 50 is driven without placing a plurality of stacked corrugated cardboard sheets Z, the torque value when the conveying unit 50 is driven without placing a plurality of stacked corrugated cardboard sheets Z, etc. By acquiring a variety of data relating to the torque value in a trial operation, the controller 40 can calculate a default value for the torque value of the supply apparatus 10. The total quantity estimation unit 41 preferably references the default value to estimate the total quantity of the plurality of stacked corrugated cardboard sheets Z.

In the supply apparatus 10 according to the present modification, the total quantity of the plurality of stacked corrugated cardboard sheets Z can be precisely estimated.

(6-3) Modification 1C

Although a description is omitted in the above embodiment, the conveying unit 50 preferably includes a pusher 114 (see FIG. 8).

The pusher 114 is a member that holds the posture of the plurality of stacked corrugated cardboard sheets Z (so that the corrugated cardboard sheets Z do not fall over rearward) accumulated on the conveying unit 50. The pusher 114 holds down the rearmost corrugated cardboard sheets Z accumulated on the conveying unit 50. Forward force is imparted to the pusher 114 by a force-imparting mechanism (not shown).

There is no limitation as to the type, but in the present modification, the force-applying mechanism is a servomotor. In the present modification, the controller 40 controls the force-applying mechanism (servomotor) so that the force that the pusher 114 exerts on the corrugated cardboard sheets Z reaches a certain predetermined value. Due to a servomotor being used as the force-applying mechanism in the present modification, the controller 40 can detect the position of the pusher 114 holding down the corrugated cardboard sheets Z on the basis of a signal from the servomotor. The controller 40 can detect the position of the rearmost corrugated cardboard sheets Z held down by the pusher 114 by detecting the position of the pusher 114 holding down the corrugated cardboard sheets Z.

Information on the position of the pusher 114 can be utilized to estimate the total quantity of corrugated cardboard sheets Z accumulated on the conveying unit 50. For example, the total quantity estimation unit 41 of the controller 40 according to the present modification may refer to the torque value as well as the information on the position of the pusher 114.

In the supply apparatus 10 according to the present modification, the total quantity of the plurality of stacked corrugated cardboard sheets Z can be precisely estimated.

When the pusher position is not detected using the force-applying mechanism, the force-applying mechanism may be, for example, a spring or another elastic body.

(6-4) Modification 1D

In the above embodiment, an example was described in which a plurality of stacked corrugated cardboard sheets Z is placed upright on the conveying surface 53*a*. However, this example is not provided by way of limitation as to the posture of the corrugated cardboard sheets Z. For example, the corrugated cardboard sheets Z may be stacked flat on the conveying surface 53*a*.

(6-5) Modification 1E

In the above embodiment, an example was described in which the storage device stores a predetermined relational expression indicating the relationship between a value pertaining to the drive force of the drive unit 60 and the total quantity of the plurality of stacked corrugated cardboard sheets Z. However, this example is not provided by way of limitation as to the information stored in the storage device. For example, a table indicating correlation between the value pertaining to the drive force of the drive unit 60 and the total quantity of the plurality of stacked corrugated cardboard sheets Z may be stored in the storage device for each type of corrugated cardboard sheet Z.

Second Embodiment (7) Configuration of Supply Apparatus 10S

A supply apparatus 10S according to a second embodiment of the present disclosure shall next be described. In the second embodiment, only components different from those of the first embodiment shall be described, and other descriptions shall be omitted.

(7-1) Weighing Unit 80

Figure 9:
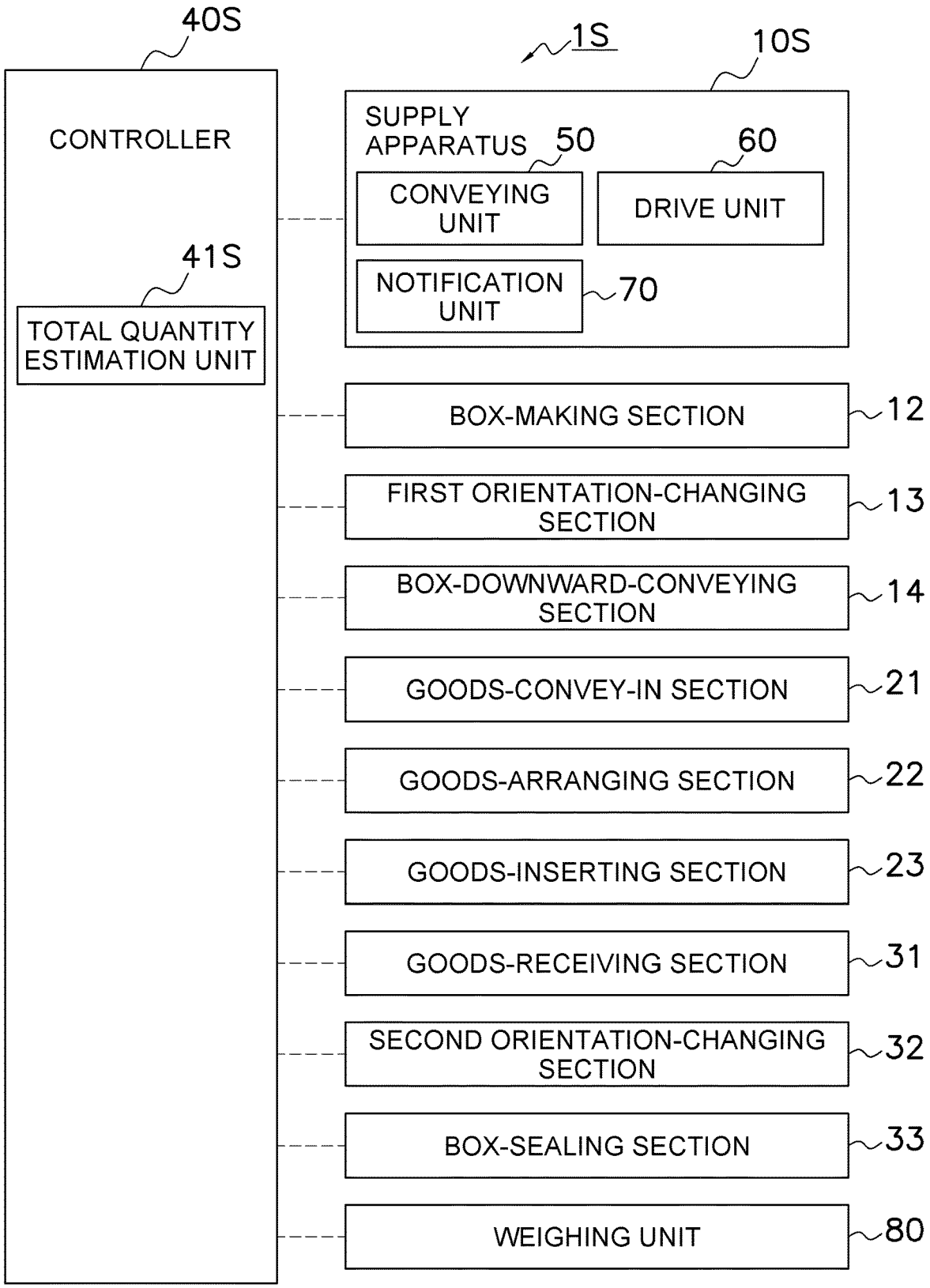
FIG. 9 is a block diagram of a box-packing system equipped with a supply apparatus according to a second embodiment.

The supply apparatus 10S according to the present embodiment comprises a weighing unit 80 (see FIG. 9). The weighing unit 80 measures the weight of the conveying unit 50 with no corrugated cardboard sheets Z placed thereon, and stores this weight. When corrugated cardboard sheets Z have been placed on the conveying unit 50, the weighing unit 80 measures the total of the weight of the conveying unit 50 and the weight of the corrugated cardboard sheets Z. The "total of the weight of the conveying unit 50 and the weight of the corrugated cardboard sheets Z" is sometimes referred to below as the total weight. When corrugated cardboard sheets Z have been placed on the conveying unit 50, the weighing unit 80 can measure the weight of the corrugated cardboard sheets Z by subtracting the weight of the conveying unit 50 with no corrugated cardboard sheets Z placed thereon from the total weight.

(7-2) Controller 40S

A storage device of the controller 40S according to the present embodiment stores the weight of one corrugated cardboard sheet Z for each type of corrugated cardboard sheet Z. In the present embodiment, the operator inputs the type of corrugated cardboard sheet Z used in the current operation to the controller 40S before starting the operation of the supply apparatus 10S. Having received this input, the controller 40S refers to the storage device to confirm the weight of 1 corrugated cardboard sheet Z to be used in the current operation. On the basis of the weight of 1 corrugated cardboard sheet Z to be used in the current operation and the value measured by the weighing unit 80, a total quantity estimation unit 41 estimates how many corrugated cardboard sheets Z constitute the plurality of stacked corrugated cardboard sheets Z placed on the conveying unit 50. For example, when the weight of 1 corrugated cardboard sheet Z to be used in the current operation is 1 kg and the weight of the corrugated cardboard sheets Z measured by the weighing unit 80 is 30 kg, the total quantity estimation unit 41 can estimate that 30 corrugated cardboard sheets Z are placed on the conveying unit 50.

(8) Characteristics

The supply apparatus according to the present embodiment is a supply apparatus 10S that supplies corrugated cardboard sheets Z to a supply position SP in a box-making section 12 that opens folded corrugated cardboard sheets Z and makes boxes. The supply apparatus comprises a weighing unit 80 and a control unit 40. The weighing unit 80 measures the weight of the plurality of stacked corrugated cardboard sheets Z. The control unit 40 estimates the total quantity of the plurality of stacked corrugated cardboard sheets Z. The control unit 40 estimates the total quantity of the plurality of stacked corrugated cardboard sheets Z on the basis of the value measured by the weighing unit 80.

In the supply apparatus 10S according to the present embodiment, the control unit 40 estimates the total quantity of the plurality of stacked corrugated cardboard sheets Z on the basis of the value measured by the weighing unit 80. Therefore, in the supply apparatus 10S according to the present embodiment, the total quantity of the plurality of stacked corrugated cardboard sheets Z can be estimated by means of an inexpensive configuration.

(9) Modification 2A

Although a description is omitted in the above embodiment, the weighing unit 80 may perform weighing continuously at least for a predetermined time or a predetermined number of times, and may calculate an average weighed value. The total quantity of the plurality of stacked corrugated cardboard sheets Z may be estimated using the average weighed value.

It is conceivable that a box-packing system 1S in operation could vibrate. This is because in the processes P1, P2, P3, and P4 executed by the box-packing system 1S, a variety of equipment installed in the box-packing system 1 is constantly in action. Vibration occurring in the box-packing system 1S could possibly affect the weighing done by the weighing unit 80. In the supply apparatus 10S according to the present modification, the total quantity of the plurality of stacked corrugated cardboard sheets Z is estimated using the average weight value. With this configuration, the total quantity of the plurality of stacked corrugated cardboard sheets Z can be estimated according to a numerical value on which the effect of vibration is suppressed.

REFERENCE SIGNS LIST

1 Box-packing system
10, 10S Supply apparatus
12 Box-making apparatus (box-making section)
40 Control unit (controller)
50 Conveying unit
53*a* Conveying surface
60 Drive unit
70 Notification unit
80 Weighing unit
Z Corrugated cardboard sheet(s)
SP Supply position

The invention claimed is:

1. A supply apparatus for supplying corrugated cardboard sheets to a supply position in a box-making apparatus that opens folded corrugated cardboard sheets and makes boxes, wherein:

the supply apparatus comprises a conveying unit configured to convey a plurality of the corrugated cardboard sheets to the supply position with the corrugated cardboard sheets stacked, a drive unit configured to drive the conveying unit, and a control unit configured to estimate the total quantity of the plurality of stacked corrugated cardboard sheets on a conveying surface of the conveying unit; and the control unit further configured to acquire a value pertaining to a drive force of the drive unit when the drive unit drives the conveying unit, and estimate the total quantity of the plurality of stacked corrugated cardboard sheets on the basis of the acquired value.

2. The supply apparatus according to the claim 1, wherein the control unit, on the basis of the estimated total quantity of the plurality of corrugated cardboard sheets, is further configured to perform a process relating to automatically or manually replenishing the corrugated cardboard sheets.

3. The supply apparatus according to claim 2, wherein the supply apparatus further comprises a notification unit configured to issue a notification of information prompting replenishing of the corrugated cardboard sheets, and the control unit is configured to perform, as said process, a process of causing the notification unit to issue a notification.

4. The supply apparatus according to claim 2, wherein the control unit is configured to perform, as said process, a process of transmitting a signal to cause an action of automatically replenishing the corrugated cardboard sheets in the supply apparatus.

5. The supply apparatus according to claim 1, wherein the control unit is configured to estimate the total quantity of the plurality of stacked corrugated cardboard sheets on the basis of a relational expression between the value pertaining to the drive force of the drive unit and the total quantity of the plurality of stacked corrugated cardboard sheets.

6. The supply apparatus according to claim 1, wherein the conveying unit is configured to convey the plurality of stacked corrugated cardboard sheets while the plurality of corrugated cardboard sheets are placed on the conveying surface so as to be inclined relative to horizontal and lower ends of the plurality of corrugated cardboard sheets are in contact with the conveying surface.

* * * * *